United States Patent [19]

Krueger

[11] 4,107,888

[45] Aug. 22, 1978

[54] MOBILE HOME SKIRTING

[76] Inventor: Lynn A. Krueger, 102 Pitcher Park, Devils Lake, N. Dak. 58301

[21] Appl. No.: 812,501

[22] Filed: Jul. 5, 1977

[51] Int. Cl.[2] ..... E04D 2/38; E04B 1/34

[52] U.S. Cl. ..... 52/169.12; 52/DIG. 3

[58] Field of Search ..... 52/169.12, DIG. 3; 296/23 R

[56] References Cited

U.S. PATENT DOCUMENTS

| | | | |
|---|---|---|---|
| 2,961,255 | 11/1960 | Trott | 52/169.12 |
| 3,042,425 | 7/1962 | Cathey et al. | 52/DIG. 3 |
| 3,562,983 | 2/1971 | Rector | 52/DIG. 3 |
| 3,753,323 | 8/1973 | Nesbitt | 52/DIG. 3 |
| 3,834,109 | 9/1974 | Iacona | 52/DIG. 3 |

*Primary Examiner*—James L. Ridgill, Jr.

*Attorney, Agent, or Firm*—Merchant, Gould, Smith, Edell, Welter & Schmidt

[57] ABSTRACT

Retractable skirting for selectively enclosing the space between the floor and ground of a structure supported above the ground surface. The skirting includes a plurality of panels mounted for vertical reciprocating movement between a first position in which the panels are stored within storage space defined in the structure side walls and a second position in which the panels are lowered into ground contact. The skirting is particularly applicable to mobile homes in which the storage space may be defined by the mobile home wall and exterior siding. The skirting panels are stored for travel and lowered when the mobile home reaches a stationary site. The panels are entirely concealed during travel in a storage space that provides maximum ground clearance for the mobile home.

15 Claims, 6 Drawing Figures

MOBILE HOME SKIRTING

BACKGROUND OF THE INVENTION

The present invention relates broadly to apparatus for selectively enclosing the space between the floor and the ground of a structure having a floor supported above the ground surface. In particular, the present invention relates to retractable mobile home skirting that is easily and conveniently stored when the mobile home is in the travel mode, and which may be lowered to enclose the space beneath the mobile home when the mobile home is at a stationary site.

Frequently, it is desirable to enclose the space immediately below a structure which is supported above the ground surface in order to prevent drafts underneath the structure and to improve the appearance thereof. In the case of mobile homes or mobile house trailers, it is desirable to have a trailer skirting which may be easily and readily lowered into engagement with the ground to enclose the space beneath the trailer. The skirting should be retractable to a storage location providing maximum ground clearance when the mobile home is prepared for the travel mode.

A number of prior art mobile home skirting apparatus have been proposed. In several of these structures, the skirting is detached from the mobile home when the mobile home is in the travel mode. Thus, when the mobile home reaches the desired stationary site, time must be consumed in a somewhat mechanically complex procedure of attaching the trailer home skirting. In still other prior art devices, the trailer home skirting is permanently secured to the bottom of the trailer home frame or floor and has a sliding portion which can further be extended into ground contact. However, in these prior art structures in which at least a portion of the skirting panels are permanently secured to extend beyond the bottom of the mobile home floor, the ground clearance of the mobile home in the travel mode is severely limited. Some prior art structures are hinged to the mobile home frame for rotation to a position where the skirting is stored beneath the mobile home floor in the travel mode. These structures also have the disadvantage of somewhat limited ground clearance in addition to providing a somewhat unsightly appearance when the mobile home is under travel. These structures are also significantly more mechanically complex than the present invention, requiring additional operator maintenance procedures.

The present invention eliminates these disadvantages associated with the prior art devices in that it is a skirting that may be retracted to an entirely concealed storage position such that the skirting in the travel mode does not extend beyond the bottom of the mobile home floor. When the mobile home reaches the desired stationary site, the skirting is simply lowered into engagement with the ground to enclose the space between the ground and the mobile home floor and to provide a pleasing exterior appearance. The present invention includes skirting panels that are stored within spaces defined by the mobile home wall and exterior siding, thus eliminating the storage problem of the prior art apparatus that must be detached from the mobile home and stored in some location while the mobile home is undergoing travel. The present invention incorporates a minimum of mechanical parts and is therefore substantially maintenance free.

SUMMARY OF THE INVENTION

The present invention, therefore, is an apparatus for selectively enclosing the space between the floor and ground of a structure having a floor supported above the ground, and includes a plurality of panels mounted for vertical reciprocating movement between a first position in which the panels are stored within a storage space provided within the side walls of the structure and a second position in which the panels are lowered into contact with the ground. The storage space has an opening proximate the floor, and the panels are spaced apart along the side walls of the structure. A releasable latch means is provided for securing the panels in the stored position.

In the preferred embodiment, the storage space is defined by exterior siding secured to each side wall of a mobile home and spaced apart therefrom by a horizontal spacer. Sealing means is provided at the opening to the storage space and in sliding contact with the panels to insulate the storage space from the environment and support the panels during their reciprocating movement. In one embodiment, the sealing means is a rubber sealing strip. A plurality of vertical spacers are secured to the exterior wall of the mobile home within the storage space at intervals substantially corresponding to the width of the skirting panels.

The present invention also includes means for joining adjacent panels together at their lateral edges when the panels are lowered into ground contact. In a preferred embodiment, the joining means includes a seam cover plate having a lateral dimension greater than the spacing between adjacent panels and means for securing the seam cover plate to the exterior surface of the panels. Seam cover means for joining the lateral edges of panels on adjacent side walls at the corners of the mobile home is also provided. The corner seam cover means includes a pair of panels each having a ninety degree bend therein and spaced apart and affixed to each other to define a space in which the adjacent lateral edges of the panels at the mobile home corners are received. A flange is also provided at the bottom edge of each of the panels and has apertures therein through which stakes may be driven to secure the panels to the ground.

In the travel mode, the panels are simply raised into the storage space and secured therein by the latch means. The skirting panels are thereby completely concealed for travel. When the mobile home reaches the desired stationary site, the latches are simply released and the panels lowered through the openings in the storage space into ground contact and staked to the ground. Seam covers are secured at the lateral edges of adjacent panels. The present invention thus provides mobile home skirting which is conveniently and rapidly raised and lowered between storage and ground-engaged positions requiring minimum time consumption. These and other advantages of my invention will become apparent with reference to the accompanying drawing, brief description of the preferred embodiment, and claims.

DETAILED DESCRIPTION OF THE PREFERRED EMBODIMENT

Figure 1:
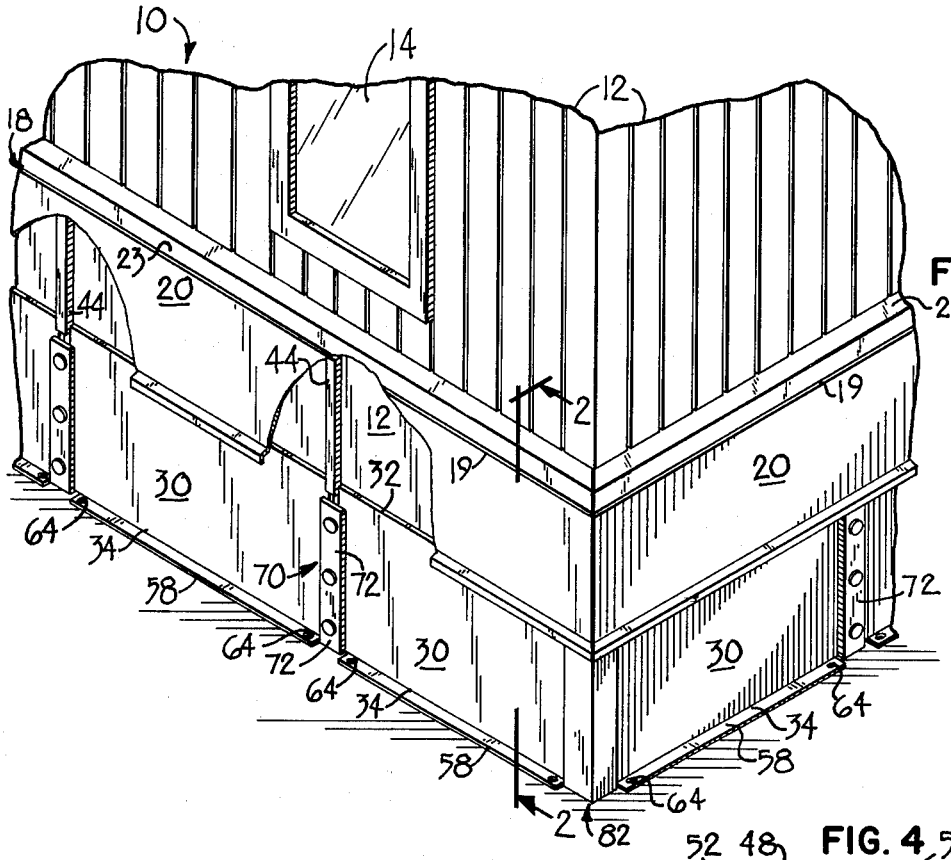
FIG. 1 is a fragmentary view in perspective of a mobile home incorporating the present invention.
Figure 2:
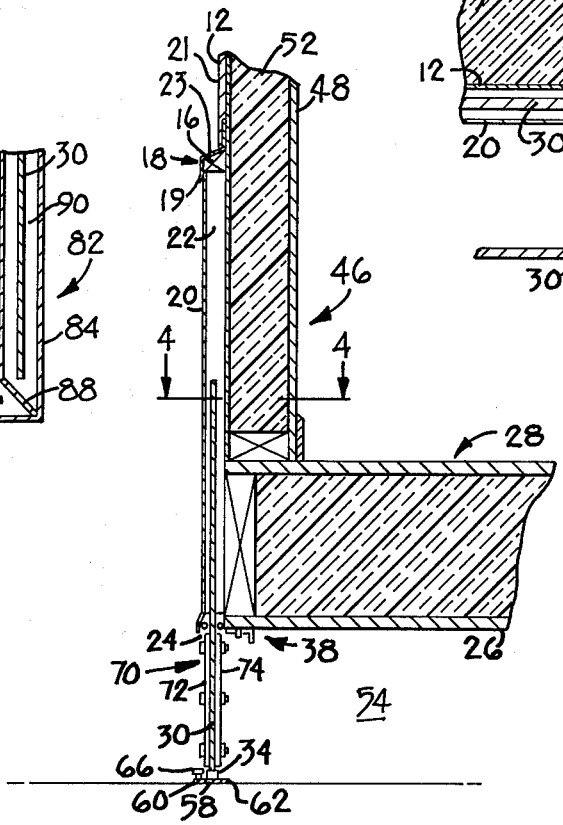
FIG. 2 is an enlarged fragmentary sectional view taken along the line 2—2 of FIG. 1.

Referring to the drawing, wherein like numerals represent like parts throughout the several views, FIG. 1 illustrates a portion of a mobile home 10 incorporating the present invention. Mobile home 10 has exterior side walls 12 in which are provided windows as at 14. Affixed to exterior walls 12 and extending horizontally therealong proximate the bottom of window 14 is a horizontal spacer 16. Horizontal spacer 16 may be a strip of metal or wood firmly attached to side wall 12. Secured to spacer 16 is a flashing member 18 having end portions 19 and 21 and a central portion 23. Affixed to portion 19 is a siding panel 20. Siding panel 20 and side wall 12 define a storage space 22 having an opening at 24 proximate a bottom floor member 26 of a mobile home floor 28. A plurality of skirting panels 30 are mounted for vertical movement within storage space 22 between a first position in which panels 30 are stored for travel within space 22 and a second position as shown more particularly in FIG. 1 and FIG. 2 in which panels 30 are in contact with the ground G. Each panel 30 has a top edge 32, a bottom edge 34, and lateral edges 36.

Figure 3:
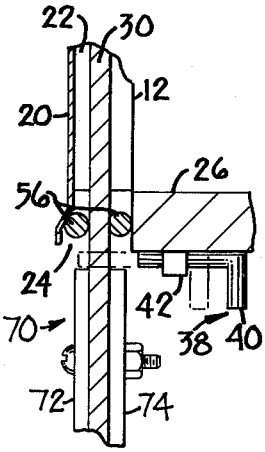
FIG. 3 is an enlarged fragmentary view in detail of a portion of FIG. 2.

A latch 38 is provided to retain panels 30 in the first or storage position. As shown more particularly in FIG. 3, latch 38 includes an L-shaped member 40 secured to floor member 26 by a fastener 42. Member 40 is movable between a retracted position as shown in FIG. 3 to allow panel 30 to be lowered into engagement with the ground G and an extended position as illustrated by the dashed lines in FIG. 3, in which panel 30 is retained within storage space 22. One or more latches 38 may be provided for each panel 30. Additionally, it will be understood that alternative latch structures other than the one specifically disclosed in the preferred embodiment are contemplated within the spirit and scope of the present invention.

Figure 4:
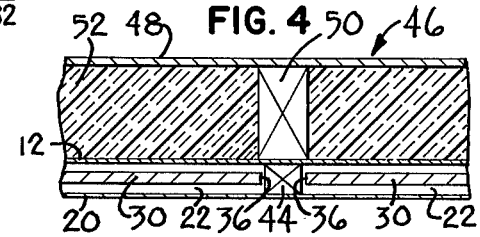
FIG. 4 is an enlarged fragmentary sectional view taken along the line 4—4 of FIG. 2.

Vertical spacers 44 are affixed to side wall 12 and siding panel 20 at spaced intervals along side wall 12. As shown particularly in FIG. 1, vertical spacers 44 are positioned along side wall 12 at intervals corresponding to the lateral width of panels 30. Vertical spacers 44 extend along substantially the entire vertical dimension of siding panel 20 to provide structural support and stability therefor. FIG. 4 illustrates in cross-section a conventional mobile home wall system 46. Wall system 46 includes exterior side wall 12 and an interior wall 48. Walls 12 and 48 are secured to and spaced apart by a wall stud 50. The space between walls 12 and 48 are typically filled with insulation 52. It can be seen that vertical spacers 44 are positioned proximate wall studs 50 so that vertical spacers 44 may be secured to the wall studs by any convenient means.

When panels 30 are in the second or down position engaging the ground G, panels 30 enclose a space 54 beneath bottom floor member 26. As illustrated more particularly in FIG. 3, a sealing strip 56 is affixed to siding panel 20 and side wall 12 proximate opening 24. Sealing strip 56 engaged panel 30 and extends the horizontal length of wall 12 and panel 20. Sealing strip 56 is preferably formed of rubber material and provides for insulation of storage space 22 in addition to preventing scratching of panels 30 as panels 30 are raised and lowered within storage space 22. Affixed to bottom edge 34 of panels 30 is a flange member 58. Flange member 58 may be provided with a portion 60 extending outward with respect to space 54 and/or a portion 62 which extends inwardly with respect to space 54. Apertures as at 64 are provided in flange portions 60 and 62 through which stakes 66 can be driven into the ground G to secure panels 30. Alternatively, flange member 58 may be provided with a single extending portion, i.e., either portion 60 or 62, and panel 30 can be simply installed such that the extending portion is directed either outwardly or inwardly with respect to enclosure space 54 in accordance with the mobile home owner's requirements. For example, panels 30 may be mounted for interior taking except at locations where entrance to enclosed space 54 is desired, in which event panels 30 would be mounted for exterior staking.

Figure 5:
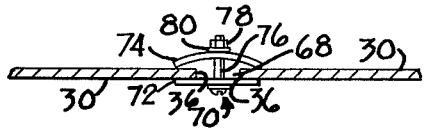
FIG. 5 is another enlarged fragmentary detail illustrating in particular the seam cover of the lateral edges of panels along the mobile home side wall.
Figure 6:
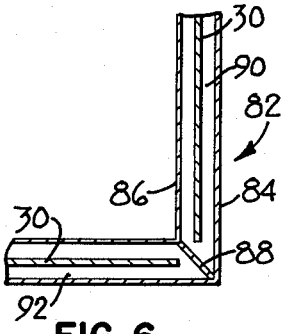
FIG. 6 is an enlarged fragmentary view illustrating in detail the seam cover at the mobile home corner.

As shown in FIG. 5, when panels 30 are in the down position, a gap 68 is present between lateral edges 36 of adjacent panels 30. To cover gap 68 and also to join panels 30 together at adjacent lateral edges 36, a joining means or seam cover 70 is provided. Seam cover 70 includes an exterior plate 72 which extends substantially along the entire length of gap 68 from opening 24 to flange member 58. Exterior plate 72 has a width greater than the width of gap 68. An interior plate 74 is also provided and may extend substantially the entire length of gap 68. Apertures (not shown) also provided in plate 72 and 74, and the plates are secured together by a bolt 76 and nut 78. A lock washer 80 may also be provided to ensure that plates 72 and 74 remain attached together. In the embodiment shown in FIG. 5, plate 74 may be a curved piece of spring steel having a lateral dimension greater than the width of gap 68. When bolt 76 and nut 78 are tightened plate 74 is somewhat compressed against panels 30 providing a firm attachment of exterior plate 72.

A seam cover 82 is provided for placement at the corners of mobile home 10. Seam cover 82 has an exterior L-shaped member 84 and an interior L-shaped 86. Members 84 and 86 are secured to each other by a joint member 88 which may comprise a rectangular plate extending the height of seam cover 82 as measured from the ground G and which is affixed to exterior member 84 and interior member 86 at its lateral edges. Members 84 and 86 define a space 90 and a space 92 into which the lateral edge portions of panels 30 at the corners of mobile home 10 are received. Seam cover 82, in a preferred embodiment, has a length, or height, substantially equivalent to the length of skirting panels 30. Wall members 84 and 86 are spaced apart sufficiently to allow free movement of panels 30 vertically into and out of spaces 90 and 92.

In operation, when mobile home 10 is prepared for travel, panels 30 are raised for storage within storage space 22 and secured by moving latch 38 to the position illustrated in dashed lines in FIG. 3. The lateral edge joining means or seam covers 70 and 82 along with the associated hardware are stored in a convenient place within the mobile home. Whe mobile home 10 reaches a desired location, latches 38 are released and panels 30 are lowered into engagement with the ground. At the corners of the mobile home 10, seam covers 82 are placed and panels 30 are lowered into spaces 90 and 92. Joining means or seam covers 82 are then secured at the lateral edges of skirting panels 30. Variations or unevenness in the level of the ground will be compensated by the fact that the panels are vertically adjustable. The majority of panels 30 will then be staked to the ground by means of inwardly extending portion 62 of flange member 58. Where it is desired to provide access to the space 54 beneath the mobile home 10, panel 30 will be staked exteriorly, or utilizing outwardly extending portions 60 of a flange member 58. In a preferred embodiment, panels 30 will be constructed with a flange member 58 that extends basically in a single transverse direction, and panels 30 will be mounted such that the extending portion faces either inward or outward as desired.

From the above description, it will be appreciated that the present invention provides mobile home skirting which is conveniently and easily stored for travel and which can easily be lowered into position to enclose the space beneath the mobile home once the mobile home reaches a desired ground location. The skirting panels are stored within a space defined by an exterior wall siding and the mobile home side walls such that ground clearance of the mobile home in the travel mode is unaffected. While specific embodiments of the present invention, such as latch 38 and seam covers 70 and 82 are disclosed, it is understood that alternative structures are contemplated within the spirit and scope of the present invention. Additionally, while the present invention is described and disclosed with particular reference to mobile home skirting, it will be understood that the present invention is equally applicable to any structure having a floor supported above the ground surface in which it is desirable to selectively enclose the space between the floor and ground.

What is claimed is:

1. In a mobile home having exterior side walls and a floor, apparatus for enclosing the space between the floor and the ground when the mobile home is in a non-travel mode comprising:

exterior siding secured to each side wall and spaced apart therefrom to define a storage space between said siding and said wall, said siding extending downward and terminating at floor level to define an opening to said storage space proximate said floor;

a plurality of rigid skirting panels mounted for vertical reciprocating movement between a first position in which said panels are stored within said storage space for travel and a second position wherein said panels are lowered through said opening into contact with the ground, each panel having top, bottom and lateral edges, an exterior surface and an interior surface, said exterior siding having a vertical dimension at least as large as the distance between said top and said bottom edges of said panels whereby said panels are completely concealed from view in said first position; and releasable latch means for securing said panels in said first position.

2. Apparatus in accordance with claim 1 further comprising a plurality of vertical spacers secured to said exterior wall and said siding within said storage space, said vertical spacers disposed at intervals substantially corresponding to the lateral width of said panels.

3. Apparatus in accordance with claim 1 further comprising a flange affixed to the bottom edge of each of said panels and extending inwardly with respect to the space enclosed by said panels, said flange having apertures therein through which stakes are driven to secure said panels to the ground.

4. Apparatus in accordance with claim 1 further comprising a flange affixed to the bottom edge of at least one of said panels, said flange extending outwardly with respect to said enclosed space and provided with apertures through which stakes may be driven to secure said panels to the ground.

5. Apparatus in accordance with claim 1 further comprising means affixed to said siding and said exterior wall at said opening to said storage space and in contact with said panels for sealing said storage space.

6. Apparatus in accordance with claim 5 wherein said sealing means further comprises a rubber sealing strip.

7. Apparatus in accordance with claim 1 wherein said panels are spaced apart along said side wall and further comprising means for joining said panels together at the adjacent lateral edges thereof when said panels are lowered to said second position.

8. Apparatus in accordance with claim 7 wherein said joining means further comprises:

a first cover plate having a lateral dimension greater than the spacing between adjacent panels; and means for securing said cover plate to the exterior surface of said panels at the lateral edge of adjacent panels whereby the spacing between adjacent panels is covered in said second position.

9. Apparatus in accordance with claim 8 wherein said securing means further comprises:

a second cover plate disposed at said lateral edges of adjacent panels on the interior side thereof and secured to said first plate by a threaded fastener extending through apertures provided in said first and second plates.

10. Apparatus in accordance with claim 7 further comprising seam cover means for joining the adjacent lateral edges of panels on adjacent side walls of said mobile homes at the corners of said mobile home.

11. Apparatus in accordance with claim 10 wherein said seam cover means further comprises a pair of panels having 90 degree bends therein, said panels spaced apart and affixed to each other to define a space in which the adjacent lateral edges of adjacent panels at the corners of said mobile home are received, said panels having a height dimension substantially equivalent to the height of said panels.

12. In combination with a structure having side walls and a floor supported above the ground surface, apparatus for selectively enclosing the space between the floor and ground comprising:

means for providing a storage space within each of said side walls, said storage space having an opening proximate said floor;

a plurality of rigid skirting panels spaced apart along said side walls and each of said panels having top, bottom, lateral edges, and exterior and interior surfaces, said panels mounted for vertical reciprocating movement between a first position in which said panels are stored within said storage space with said bottom edges thereof extending no lower than the level of said floor and a second position wherein said panels are lowered through said opening into contact with the ground, said storage space sized to receive said panels in said first position so that said panels are completely concealed from view; and releasable latch means for securing said panels in said first position.

13. Apparatus in accordance with claim 12 further comprising a flange affixed to said bottom edge of each of said panels, said flange having apertures therein through which stakes are driven to secure said panels to the ground surface.

14. Apparatus in accordance with claim 12 further comprising means for joining said panels together at adjacent lateral edges thereof when said panels are lowered to said second position.

15. Apparatus in accordance with claim 14 wherein said joining means further comprises a seam cover plate having a lateral dimension greater than the spacing between adjacent panels and means for securing said cover plate to the exterior surface of said panels whereby the spacing between adjacent panels in said second position is covered.

* * * * *